United States Patent [19]

Stinson

[11] Patent Number: 5,060,583

[45] Date of Patent: Oct. 29, 1991

[54] FLOOR SAFE

[76] Inventor: Martin J. Stinson, 1250 Industroal Ave., Escondido, Calif. 92029

[21] Appl. No.: 649,994

[22] Filed: Feb. 4, 1991

[51] Int. Cl.[5] ..... E05G 1/00; E05G 1/04

[52] U.S. Cl. ..... 109/50; 109/59 T; 109/68; 70/204

[58] Field of Search ..... 109/50, 51, 52, 59 R, 109/59 T, 67, 68, 73; 70/160, 161, 162, 204; 49/386

[56] References Cited

U.S. PATENT DOCUMENTS

| | | | |
|---|---|---|---|
| 1,854,839 | 4/1932 | Hermann | 109/72 |
| 4,145,843 | 3/1979 | Lyons | 49/386 |
| 4,193,353 | 3/1980 | Hinton et al. | 109/50 |
| 4,370,874 | 2/1983 | Munn | 70/204 |
| 4,404,916 | 9/1983 | Ingram | 109/64 |
| 4,408,545 | 10/1983 | Lichter | 109/50 |
| 4,481,888 | 11/1984 | Cartwright et al. | 109/50 |
| 4,715,297 | 12/1987 | Lichter | 109/50 |
| 4,852,503 | 8/1989 | Lichter | 109/59 R |

*Primary Examiner*—Neill R. Wilson

*Attorney, Agent, or Firm*—Brown, Martin, Haller & McClain

[57] ABSTRACT

The safe is an upwardly opening box-like structure. A door panel has at least one door closure cushioning and delaying apparatus connected to the door panel and to the structure. A locking shelf has at least one slotted port. A locking initiation member has a lower section adjacent a drill resistent reinforcement place. The locking initiation member has a locking tongue that slidingly and releasingly locks into a locking tongue recess in the bolt plate. Locking tabs on the bolt plate extend through the slotted ports and under the lentil support shelf when the bolt plate is rotated to a locked position. At least one position retaining pin in the bolt plate aligns the locking tabs in the slotted ports and to limit lateral and longitudinal movement of the bolt plate. The control handle has a reduced diameter section that breaks when a preselected amount of torque is applied to the shaft. An anti-tamper locking device has a bolt biased to an extended locking position from a retracted release position that projects into a recess on the bolt plate when the anti-tamper device retainer is removed during forced entry thus keeping the rotating bolt plate from being forced to an unlocked position.

7 Claims, 3 Drawing Sheets

FLOOR SAFE

BACKGROUND OF THE INVENTION

1. Field of the Invention

This invention relates to a floor safe having a rotating bolt plate that reduces warp and wear caused by other locking devices and provides several deterrents to forcible entry.

2. Description of the Related Art

U.S. Pat. No. 1,854,839 to J. Hermann on Apr. 19, 1932 shows a safe having a removable door that is cammed under a protective flange and then locked in place by a key operated rectangular locking bolt.

U.S. Pat. No. 4,404,916 to B. M. Ingram on Sept. 20, 1983 describes a safe having a hinged door with springs to deter free fall of the door and a pair of locking stays on the door to deter an effort to pry off the door.

U.S. Pat. No. 4,481,888 to W. G. Cartwright, et al., on Nov. 13, 1984 shows a cylindrical safe having a closure with a sliding bolt that pushes a ring into a captive position in a groove located in the body of the safe thus locking the closure to the body.

SUMMARY OF THE INVENTION

Floor safes are used in both commercial and residential buildings for the storage of valuable items. Forcible entry of a safe is often accomplished by utilizing sledge hammers and pry bars. Some criminals even use a block and tackle to remove the entire safe from the floor to be able to force the safe open at their leisure. The design of the present safe greatly diminishes the probability of successfully removing the safe or forcing the safe door open.

Another problem plaguing floor safes is the damage caused when the door (which is usually quite heavy) is dropped shut rather that carefully lowered into a closed position. Cylindrical, hardened steel bolts commonly used in most safes present a thin line of contact between the bolt and the portion of the safe that the bar strikes when it falls shut. Since the door is heavy and the weight is distributed over a small area when the door falls shut, the force is tremendous. As an example, if the striking area is only ⅛ inch square, that presents an area of 0.0039 square inches. If the door weighs 50 pounds, the force applied to that small area is over 6 tons. Therefore, the useful life of most safes are rapidly diminished if the users are carelessness. The present safe greatly reduces the chance of damage due to its unique design.

A safe is described herein that has an upwardly opening boxlike structure having a plurality of side walls and a bottom wall. There is a side flange on at least one of the side walls and a bottom flange on the bottom wall. The flanges anchor the structure in the concrete of the floor into which the safe is usually placed and make it difficult for a burglar to hoist the safe out of the floor to work on later at a remote location. There is a lintel support shelf on a perimeter of an inner chamber formed by the side walls. A plurality of support braces are attached to the support shelf and to the bottom wall to brace the lintel shelf. Thus the lintel shelf resists bending or breaking to a much greater degree. This reduces the chance that the door could be beaten inwardly or pried outwardly to gain access to the interior of the safe. A door panel is hingingly connected to the structure. Removal of the hinges is from the inner chamber of the safe. The hingecovers are bolted to the structure from within the chamber. Therefore, illegal access to hinges to remove them is impeded. There is at least one door cushioning and delaying apparatus connected to the door panel and the structure. A locking apparatus is connected to the door panel to lock the door panel to the structure. There is a floor plate cover removably placed over the door panel and over an upward opening of the structure.

The locking apparatus may have a locking shelf attached to a lower wall of the door panel. There may be at least one slotted port in the locking shelf. A lock mechanism may be attached to the door panel. There is a drill resistant reinforcement plate adjacent to and attached to the lower wall of the door panel. The reinforcement plate reduces the chance that someone might disable the lower section of the combination or key lock by drilling through the door or lock. At least one door panel brace may be attached to the lower wall of the door panel. The brace may have a lower portion that is placed under the lintel shelf when the door panel hingingly closes. The brace makes it difficult to pry the door off near the hinges. There may be an internal locking mechanism cover lid attached to the locking shelf to deny anyone from viewing the inner mechanisms.

The locking mechanism may also have a locking initiation member (such as a combination or key lock) extending through the door panel and may have a lower section, attached to the locking initiation member, adjacent the reinforcement plate. The lower section may have a locking tongue slidingly attached to the lower section. The locking initiation member releasingly locks the locking tongue in an extended second position from a retracted first position (unlocked position). A rotating control handle may extend through the door panel.

A rotating bolt plate may be attached to the control handle. The bolt plate may have at least one locking tab and at least one plate support tab thereon. The locking tabs may extend through the slotted ports and under the lentil support shelf when the bolt plate is rotated to a locked position and the plate support tabs may extend through the slotted ports when the bolt plate is rotated to an open position. There may be a locking tongue recess in the bolt plate to receive the locking tongue, when the locking tongue is in the extended second position, to lock the bolt plate when the bolt plate is rotated to the locked position. A door cushioning and delaying apparatus mount may be attached to the lower wall of the door panel to limit the rotation of the bolt plate.

The locking mechanism may also have at least one position retaining pin in the bolt plate to align the locking tabs in the slotted ports and to limit lateral and longitudinal movement of the bolt plate. A shaft may extend from the control handle and may be attached to the bolt plate. A section of the shaft of the control handle may have a reduced diameter that breaks when a preselected amount of torque is applied to the shaft. The reduced diameter section of the shaft acts as a weak link when someone tries to force the door open by turning the handle hard to try to rotate the bolt plate out of it's locked position. The shaft parts at the reduced diameter portion when over torqued.

Even if the burglar is persistent and manages to dislodge the lower section of the combination or key lock, there is an additional locking device that further impedes entry into the safe. The locking mechanism may further comprise an anti-tamper locking device that has a bolt biased to an extended locking position from a retracted release position. The anti-tamper locking device may be attached to the lower wall of the door panel. There may be an anti-tamper locking device recess in the bolt plate to receive the bolt. An anti-tamper locking device retainer may be attached to the lower section of the locking initiation member to releasingly maintain the bolt in the retracted release position. If the lower section of the lock is displaced, the retainer is displaced also. When the retainer releases the spring biased bolt, the bolt enters the anti-tamper recess in the bolt plate and relocks the bolt plate and keeps it from rotating.

It is an object of this invention to provide a safe with a locking bolt plate that distributes the large forces that can be applied to the locking mechanism of a safe, due to careless closure and attempts to force entry, over a larger surface area.

It is another object of this invention to provide a safe that has several backup security measures such as a anti-tamper locking mechanism that acts as a backup lock should a burglar be persistent enough to remove the primary lock.

DESCRIPTION OF THE PREFERRED EMBODIMENT

Figure 1:
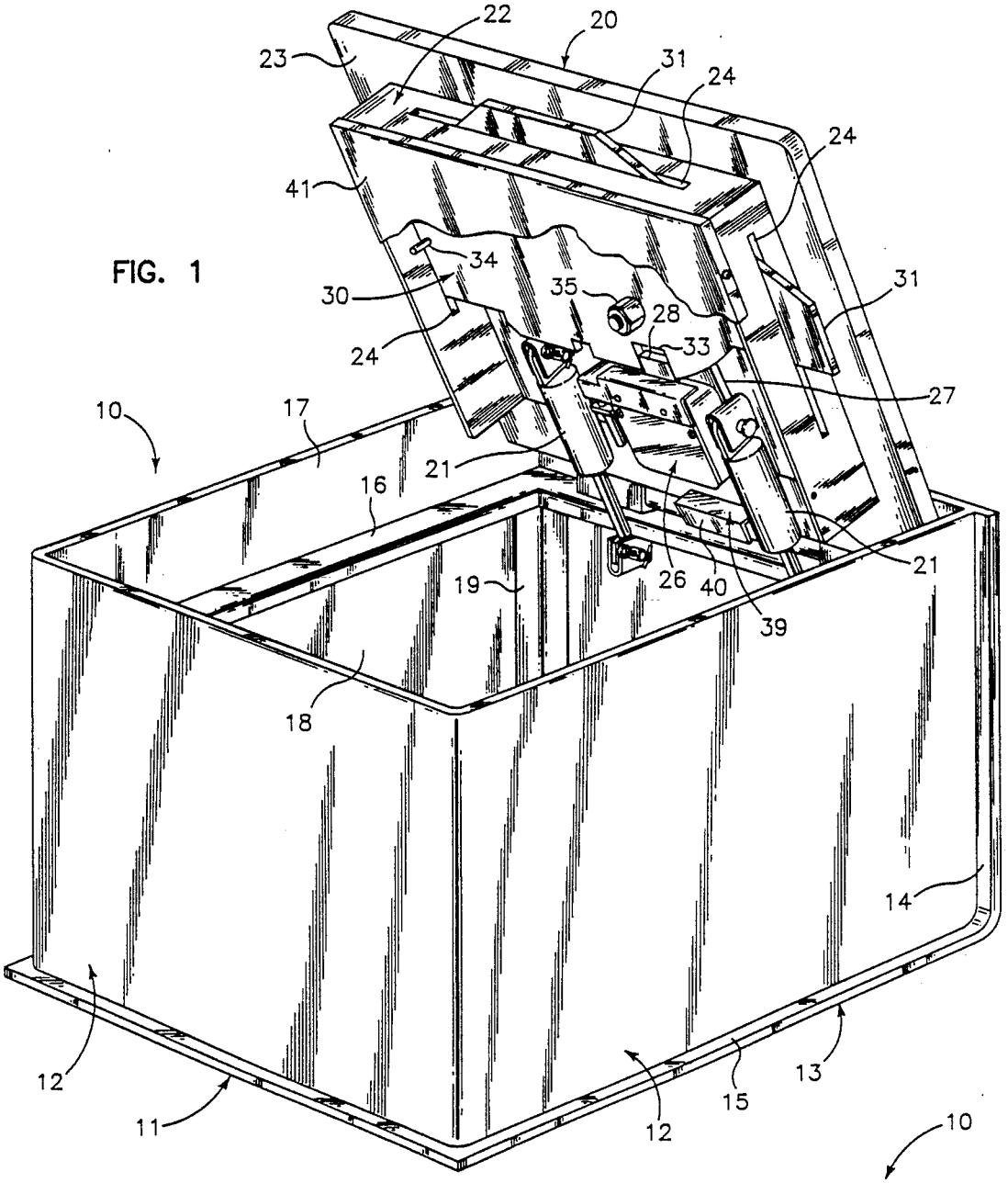
FIG. 1 is a perspective view of the safe showing the door panel open and the rotating bolt locking plate in the locked position.
Figure 2:
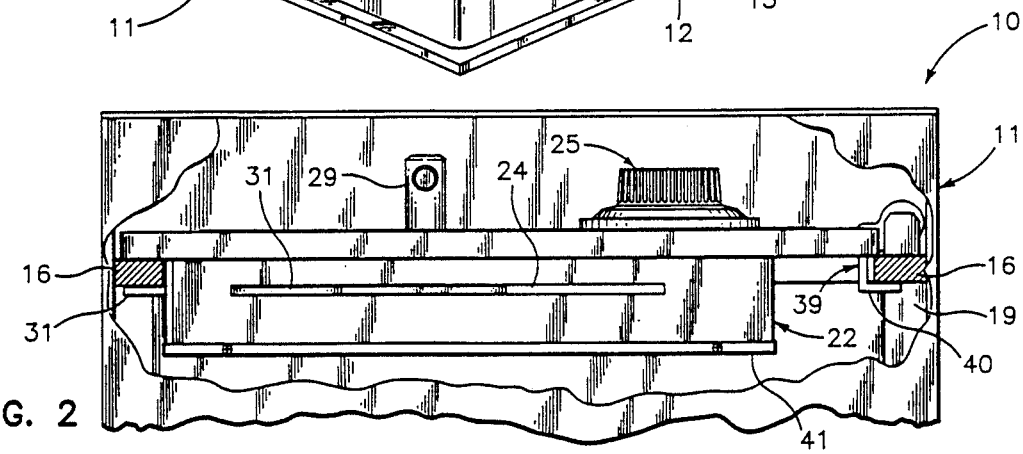
FIG. 2 is a partial side view, partly in section and partly in elevation, showing the door panel closed and the bolt plate rotated to the locked position with the locking tabs extending through the slotted ports and under the lintel shelf. The door panel brace is shown with a lower portion under the lintel shelf.

In FIGS. 1 through 9, a safe 10 is shown having an upwardly opening box-like structure 11 having a plurality of side walls 12 and a bottom wall 13. There is a side flange 14 on at least one of the side walls 12 and a bottom flange 15 on the bottom wall 13. There is a lintel support shelf 16 on a perimeter 17 of an inner chamber 18. The perimeter 17 is formed by the side walls 12. The chamber 18 is formed by side walls 12 and bottom wall 13. A plurality of support braces 19 are attached to the lintel support shelf 16 and to the bottom wall 13.

A door panel 20 is hingingly connected to the structure 11. There is at least one door cushioning and delaying apparatus 21 connected to the door panel 20 and to the structure 11 at one of the side walls 12. A locking shelf 22 is attached to a lower wall 23 of the door panel 20.

There is at least one slotted port 24 in the locking shelf 22. A locking initiation member 25 extends through the door panel 20. The locking initiation member 25 has a lower section 26 adjacent a drill resistant hardened reinforcement plate 27 attached to the lower wall 23 of the door panel 20. The lower section 26 has a locking tongue 28 slidingly attached to it. The locking initiation member 25 releasingly locks the locking tongue 28 in an extended second position (shown in FIGS. 1 and 3) from a retracted first position (shown in FIG. 4).

A rotating control handle 29 extends through the door panel 20. A rotating bolt plate 30 is attached to the control handle 29. The handle 29 rotates the rotating bolt plate 30. The bolt plate 30 has at least one locking tab 31 and at least one plate support tab 32 on it. The locking tabs 31 extend through the slotted ports 24 and under the lentil support shelf 16 when the bolt plate 30 is rotated to a locked position (shown in FIGS. 1, 2 and 3). The plate support tabs 32 extend through the slotted ports 24 when the bolt plate 30 is rotated to an open position (shown in FIG. 4). The support tabs support the weight of the bolt plate and help keep the bolt plate aligned to enter the slots 24 smoothly.

Figure 3:
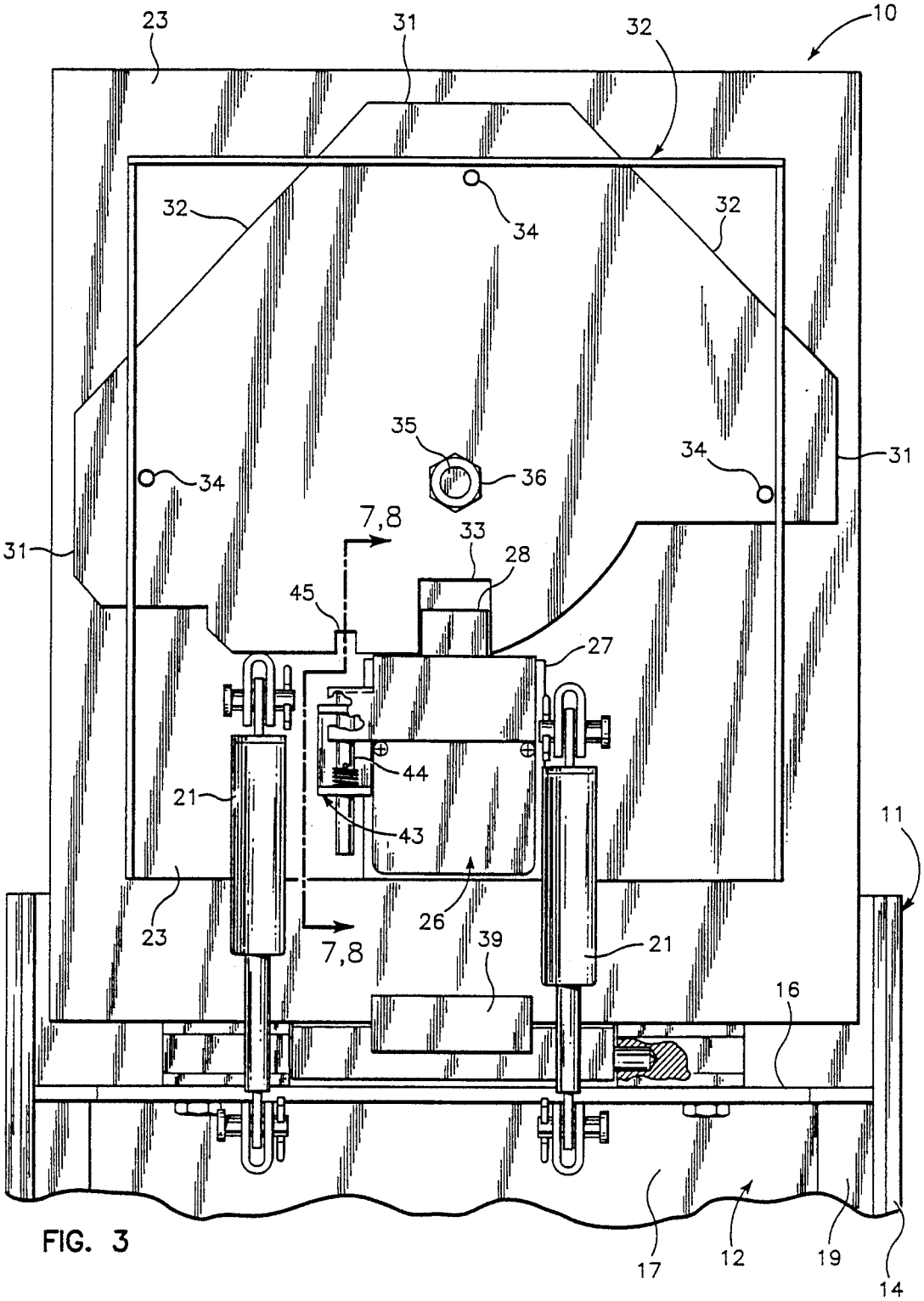
FIG. 3 is a bottom view of the door panel shown attached to a partial view of the structure. The manner of attaching the hinges is shown and the locking tongue of the locking initiation member is shown in the extended second position and in the locking tongue recess.
Figure 4:
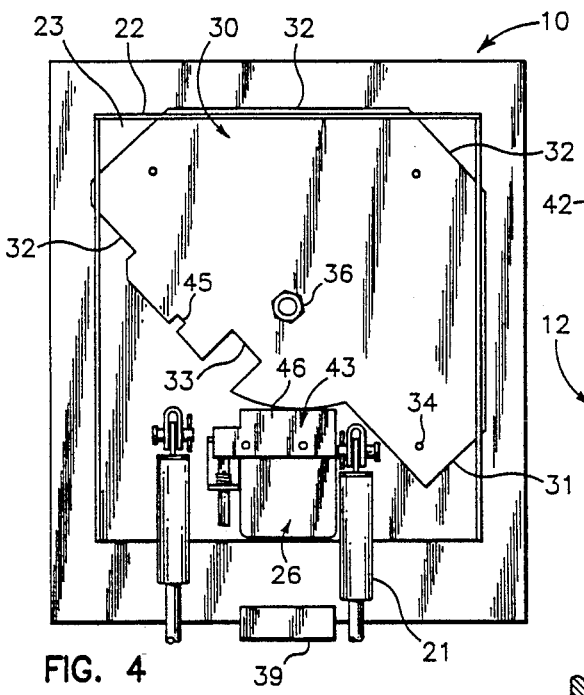
FIG. 4 is a bottom view of the door panel showing the bolt plate in the unlocked position and showing the support tabs in place in the slotted ports of the locking shelf. The locking tongue is shown in the retracted first position.
Figure 5:
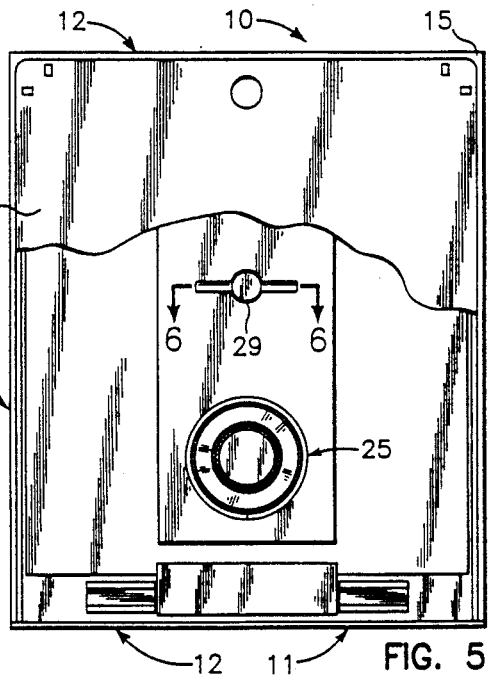
FIG. 5 is a top view of the door panel in the closed position and shows a partial view of the floor plate cover placed over the door panel.
Figure 6:
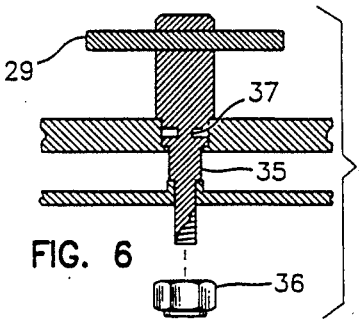
FIG. 6 is a cross-sectional view along lines 6—6 of FIG. 5 showing a cross-section of the rotating control handle and the shaft and showing the reduced diameter portion of the shaft.
Figure 7:
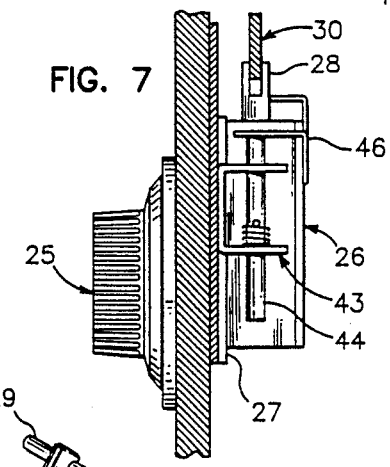
FIG. 7 is a cross-sectional area taken along lines 7—7 of FIG. 3 showing the anti-tamper locking device in the retracted release position held in place by the anti-tamper locking device retainer.
Figure 8:
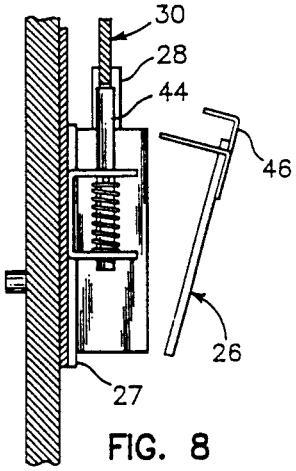
FIG. 8 is a cross-sectional view taken along lines 8—8 of FIG. 3 showing the anti-tamper locking device in the extended locking position and showing the lower section of the locking initiation member and the anti-tamper locking device retainer dislodged allowing the spring biased bolt to enter the anti-tamper locking device recess on the bolt plate.
Figure 9:
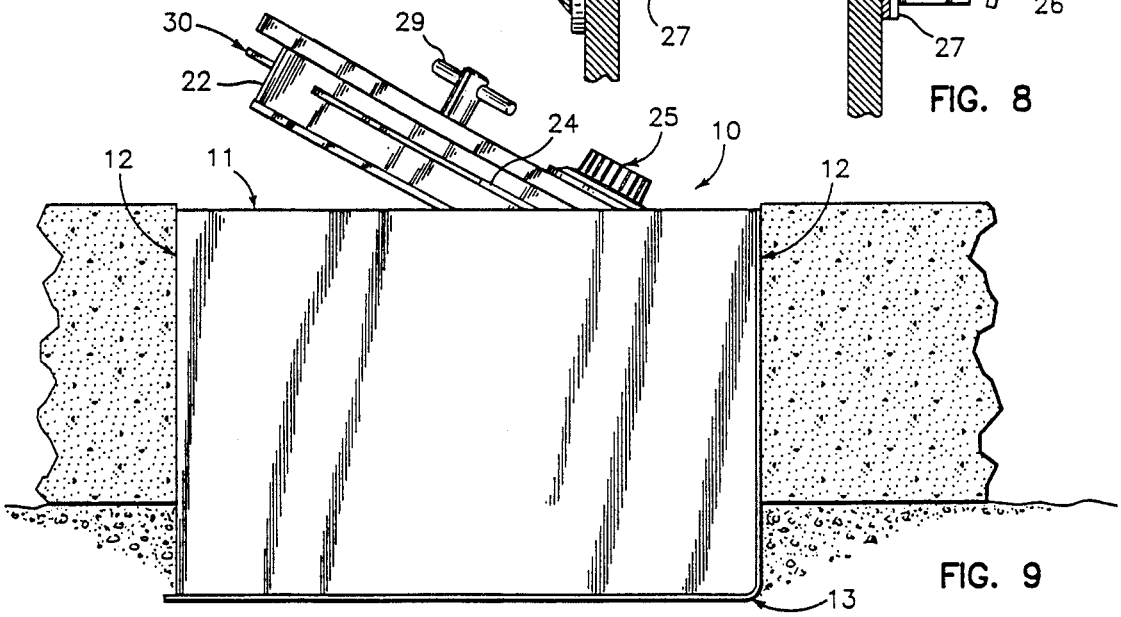
FIG. 9 is a side view of the safe place in a floor to show how the side and bottom flange impede removal of the safe and showing the door panel open.

There is a locking tongue recess 33 in the bolt plate 30 to receive the locking tongue 28 when the locking tongue 28 is in the extended second position (shown in FIG. 3). This keeps the bolt plate 30 from rotating further once the bolt plate 30 is rotated to the locked position (shown in FIG. 3). There is at least one position retaining pin 34 in the bolt plate 30 to align the locking tabs 31 in the slotted ports 24 and to limit lateral and longitudinal movement of the bolt plate 30.

A shaft 35 extends from and is part of the control handle 29. The handle 29, by means of the shaft 35, is attached to the bolt plate 30 by a fastener 36. There is a section of the shaft 35 of the control handle 29 that has a reduced diameter 37 (see FIG. 6) that breaks when a preselected amount of torque is applied to the shaft 35. A door cushioning and delaying apparatus mount is attached to the lower wall 23 of the door panel 20 and limits the rotation of the bolt plate 30 when the bolt plate is rotated to the unlocked position.

At least one door panel brace 39 is attached to the lower wall 23 of the door panel 20. The brace 39 has a lower portion 40 that is placed under the lintel support shelf 16 when the door panel 20 hingingly closes (see FIG. 2). There is an internal locking mechanism cover lid 41 attached to the locking shelf 22 to cover the mechanisms of the lock. A floor plate cover 42 is removably placed over the door panel 20 and over an upward opening of the upwardly opening box-like structure 11 (See FIG. 5).

There is an anti-tamper locking device 43 that has a bolt 44 biased to an extended locking position (shown in FIG. 8) from a retracted release position (shown in FIGS. 1, 3, 4, and 7). The anti-tamper locking device 43 is attached to the lower wall 23 of the door panel 20. There is an anti-tamper locking device recess 45 in the bolt plate 30 to receive the bolt 44. There is an anti-tamper locking device retainer 46 that is attached to the lower section 26 of the locking initiation member 25 (a combination or key lock mechanism, a combination is shown in the drawings) to releasingly maintain the bolt 44 in the retracted release position.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A safe comprising:

a. an upwardly opening box-like structure having a plurality of side walls and a bottom wall;

b. a side flange on at least one of the side walls;

c. a bottom flange on the bottom wall;

d. a lintel support shelf on a perimeter of an inner chamber formed by the side walls;

e. a plurality of support braces attached to the support shelf and to the bottom wall;

f. a door panel hingingly connected to the structure;

g. at least one door closure cushioning and delaying apparatus connected to the door panel and the structure;

h. a locking apparatus connected to the door panel to lock the door panel to the structure; and i. a floor plate cover removably placed over the door panel and over an upward opening of the structure.

2. A safe as described in claim 1 wherein the locking apparatus further comprises:

a. a locking shelf attached to a lower wall of the door panel;

b. at least one slotted port in the locking shelf;

c. a lock mechanism attached to the door panel;

d. a drill resistant reinforcement plate adjacent to and attached to the lower wall of the door panel;

e. at least one door panel brace attached to the lower wall of the door panel and the brace having a lower portion that is placed under the lintel shelf when the door panel hingingly closes; and f. an internal locking mechanism cover lid attached to the locking shelf.

3. A safe as described in claim 2 wherein the locking mechanism further comprises:

a. a locking initiation member extending through the door panel and having a lower section adjacent the reinforcement plate;

b. the lower section having a locking tongue slidingly attached thereto;

c. the locking initiation member releasingly locking the locking tongue in an extended second position from a retracted first position;

d. a rotating control handle extending through the door panel;

e. a rotating bolt plate, attached to the control handle;

f. the bolt plate having at least one locking tab and at least one plate support tab thereon;

g. the locking tabs extending through the slotted ports and under the lentil support shelf when the bolt plate is rotated to a locked position and the plate support tabs extending through the slotted ports when the bolt plate is rotated to an open position;

h. a locking tongue recess in the bolt plate to receive the locking tongue, when the locking tongue in the extended second position, to lock the bolt plate when the bolt plate is rotated to the locked position; and i. a door closure cushioning and delaying apparatus mount attached to the lower wall of the door panel to limit the rotation of the bolt plate.

4. A safe as described in claim 3 wherein the locking mechanism further comprises:

a. at least one position retaining pin in the bolt plate to align the locking tabs in the slotted ports and to limit lateral and longitudinal movement of the bolt plate;

b. a shaft extending from the control handle and attached to the bolt plate; and c. a section of the shaft of the control handle having a reduced diameter that breaks when a preselected amount of torque is applied to the shaft.

5. A safe as described in claim 3 wherein the locking mechanism further comprises:

a. an anti-tamper locking device, having a bolt biased to an extended locking position from a retracted release position, attached to the lower wall of the door panel;

b. an anti-tamper locking device recess in the bolt plate to receive the bolt; and c. an anti-tamper locking device retainer, attached to the lower section of the locking initiation member, to releasingly maintain the bolt in the retracted release position.

6. A safe comprising:

a. an upwardly opening box-like structure having a plurality of side walls and a bottom wall;

b. a side flange on at least one of the side walls;

c. a bottom flange on the bottom wall;

d. a lintel support shelf on a perimeter of an inner chamber formed by the side walls;

e. a plurality of support braces attached to the support shelf and to the bottom wall;

f. a door panel hingingly connected to the structure;

g. at least one door closure cushioning and delaying apparatus; connected to the door panel and the structure;

h. a locking shelf attached to a lower wall of the door panel;

i. at least one slotted port in the locking shelf;

j. a locking initiation member extending through the door panel and having a lower section adjacent a drill resistent reinforcement plate adjacent and attached to the lower wall of the door panel;

k. the lower section having a locking tongue slidingly attached thereto;

l. the locking initiation member releasingly locking the locking tongue in an extended second position from a retracted first position;

m. a rotating control handle extending through the door panel;

o. a rotating bolt plate, attached to the control handle;

p. the bolt plate having at least one locking tab and at least one plate support tab thereon;

q. the locking tabs extending through the slotted ports and under the lentil support shelf when the bolt plate is rotated to a locked position and the plate support tabs extending through the slotted ports when the bolt plate is rotated to an open position;

r. a locking tongue recess in the bolt plate to receive the locking tongue, when the locking tongue in the extended second position, to lock the bolt plate when the bolt plate is rotated to the locked position;

s. a door closure cushioning and delaying apparatus mount attached to the lower wall of the door panel to limit the rotation of the bolt plate;

t. at least one door panel brace attached to the lower wall of the door panel and the brace having a lower portion that is placed under the lintel shelf when the door panel hingingly closes;

u. an internal locking mechanism cover lid attached to the locking shelf; and v. a floor plate cover removably placed over the door panel and over an upward opening of the structure.

7. A safe comprising:

a. an upwardly opening box-like structure having a plurality of side walls and a bottom wall;

b. a side flange on at least one of the side walls;

c. a bottom flange on the bottom wall;

d. a lintel support shelf on a perimeter of an inner chamber formed by the side walls;

e. a plurality of support braces attached to the support shelf and to the bottom wall;

f. a door panel hingingly connected to the structure;

g. at least one door closure cushioning and delaying apparatus connected to the door panel and the structure;

h. a locking shelf attached to a lower wall of the door panel;

i. at least one slotted port in the locking shelf;

j. a locking initiation member extending through the door panel and having a lower section adjacent a drill resistent reinforcement plate adjacent and attached to the lower wall of the door panel;

k. the lower section having a locking tongue slidingly attached thereto;

l. the locking initiation member releasingly locking the locking tongue in an extended second position from a retracted first position;

m. a rotating control handle extending through the door panel;

o. a rotating bolt plate, attached to the control handle;

p. the bolt plate having at least one locking tab and at least one plate support tab thereon;

q. the locking tabs extending through the slotted ports and under the lentil support shelf when the bolt plate is rotated to a locked position and the plate support tabs extending through the slotted ports when the bolt plate is rotated to an open position;

r. a locking tongue recess in the bolt plate to receive the locking tongue, when the locking tongue in the extended second position, to lock the bolt plate when the bolt plate is rotated to the locked position;

s. at least one position retaining pin in the bolt plate to align the locking tabs in the slotted ports and to limit lateral and longitudinal movement of the bolt plate;

t. a shaft extending from the control handle and attached to the bolt plate;

u. a section of the shaft of the control handle having a reduced diameter that breaks when a preselected amount of torque is applied to the shaft;

v. a door closure cushioning and delaying apparatus mount attached to the lower wall of the door panel to limit the rotation of the bolt plate;

w. at least one door panel race attached to the lower wall of the door panel and the brace having a lower portion that is placed under the lintel shelf when the door panel hingingly closes;

x. an internal locking mechanism cover lid attached to the locking shelf; and y. a floor plate cover removably placed over the door panel and over an upward opening of the structure.

* * * * *

UNITED STATES PATENT AND TRADEMARK OFFICE

CERTIFICATE OF CORRECTION

PATENT NO. : 5,060,583

DATED : October 29, 1991

INVENTOR(S) : Martin J. Stinson

It is certified that error appears in the above-identified patent and that said Letters Patent is hereby corrected as shown below:

Column 8, Line 33, "race" should read --brace--.

Signed and Sealed this

Ninth Day of March, 1993

*Attest:*

STEPHEN G. KUNIN

*Attesting Officer*

*Acting Commissioner of Patents and Trademarks*